US012104255B2

(12) United States Patent
Machado Amorim et al.

(10) Patent No.: US 12,104,255 B2
(45) Date of Patent: Oct. 1, 2024

(54) PHOSPHATABLE PART STARTING FROM A STEEL SHEET COATED WITH A METALLIC COATING BASED ON ALUMINUM

(71) Applicant: ArcelorMittal, Luxembourg (LU)

(72) Inventors: Tiago Machado Amorim, Longeville les Metz (FR); Christian Allely, Metz (FR); Gregory Leuillier, Hagondange (FR)

(73) Assignee: ArcelorMittal, Luxembourg (LU)

( * ) Notice: Subject to any disclaimer, the term of this patent is extended or adjusted under 35 U.S.C. 154(b) by 91 days.

(21) Appl. No.: 17/866,628

(22) Filed: Jul. 18, 2022

(65) Prior Publication Data

US 2022/0356552 A1 Nov. 10, 2022

Related U.S. Application Data

(62) Division of application No. 15/748,262, filed as application No. PCT/IB2016/001076 on Jul. 29, 2016, now Pat. No. 11,414,737.

(30) Foreign Application Priority Data

Jul. 30, 2015 (WO) ..... PCT/IB2015/001285

(51) Int. Cl.
*C23C 2/12* (2006.01)
*C21D 1/673* (2006.01)
(Continued)

(52) U.S. Cl.
CPC ..... *C23C 2/12* (2013.01); *C21D 1/673* (2013.01); *C21D 8/0257* (2013.01); *C23C 2/06* (2013.01);
(Continued)

(58) Field of Classification Search
CPC .... C23C 2/06; C23C 2/12; C23C 2/26; C23C 2/261; C23C 2/28; C23C 2/29;
(Continued)

(56) References Cited

U.S. PATENT DOCUMENTS 6,635,359 B1 10/2003 Kurosaki et al.
7,867,344 B2 1/2011 Kusumi et al.
(Continued)

FOREIGN PATENT DOCUMENTS

CN 102011082 A 4/2011
CN 104388870 A 3/2015
(Continued)

OTHER PUBLICATIONS

Hauger A et al, "Flexibles Walzen Von Tailer Rolled Blanks// Flexible Rolling of Tailor Rolled Blanks", Stahl und Eisen, Verlag Stahleisen, Jan. 1, 2006, pp. 21-23, vol. 126, No. 5, Dusseldorf, DE See English Abstract.
(Continued)

*Primary Examiner* — Lois L Zheng
(74) *Attorney, Agent, or Firm* — Davidson Kappel LLC

(57) ABSTRACT

A hardened part coated with a phosphatable coating is provided. The part is made by a method that includes providing a steel sheet pre-coated with a metallic coating including from 4.0 to 20.0% by weight of zinc, from 1.0 to 3.5% by weight of silicon, optionally from 1.0 to 4.0% by weight of magnesium, and optionally additional elements chosen from Pb, Ni, Zr, or Hf, the content by weight of each additional element being less than 0.3% by weight, the balance being aluminum and unavoidable impurities and residuals elements. The steel sheet is cut to obtain a blank, the blank is thermally treated at a temperature between 840 and 950° C. to obtain a fully austenitic microstructure in the steel, the blank is transferred into a press tool and hot-
(Continued)

formed to obtain a part. The part is cooled to obtain a martensitic or martensitic-bainitic microstructure or made of at least 75% of equiaxed ferrite, from 5 to 20% of martensite and bainite in amount less than or equal to 10%.

12 Claims, 1 Drawing Sheet

(51) Int. Cl.

| | |
|---|---|
| ***C21D 8/00*** | (2006.01) |
| ***C21D 8/02*** | (2006.01) |
| ***C23C 2/06*** | (2006.01) |
| ***C23C 2/26*** | (2006.01) |
| ***C23C 2/28*** | (2006.01) |
| *C22C 21/10* | (2006.01) |
| *C22F 1/053* | (2006.01) |
| *C23C 22/07* | (2006.01) |

(52) U.S. Cl.
CPC ..... *C23C 2/26* (2013.01); *C23C 2/261* (2022.08); *C23C 2/28* (2013.01); *C23C 2/29* (2022.08); *C21D 2211/002* (2013.01); *C21D 2211/005* (2013.01); *C21D 2211/008* (2013.01)

(58) Field of Classification Search
CPC ..... C23C 2/40; C23C 22/07; C23C 22/78; C23C 28/00; C21D 1/673; C21D 2211/002; C21D 2211/005; C21D 2211/008; C21D 8/0257; C21D 9/46
See application file for complete search history.

(56) References Cited

U.S. PATENT DOCUMENTS

| | | | |
|---|---|---|---|
| 8,453,482 | B2 | 6/2013 | Maki et al. |
| 9,034,480 | B2 | 5/2015 | Yoshida et al. |
| 9,074,277 | B2 | 7/2015 | Maki et al. |
| 9,234,267 | B2 | 1/2016 | Yoshida et al. |
| 9,296,520 | B2 | 3/2016 | Watakabi |
| 2005/0142294 | A1 | 6/2005 | Marutian |
| 2007/0163685 | A1 | 7/2007 | Kusumi et al. |
| 2007/0271978 | A1 | 11/2007 | Brandstatter et al. |
| 2010/0221572 | A1 | 9/2010 | Laurent et al. |
| 2010/0282373 | A1 | 11/2010 | Van Tol et al. |
| 2010/0319426 | A1 | 12/2010 | Pohl et al. |
| 2011/0274945 | A1 | 11/2011 | Shimoda et al. |
| 2011/0303328 | A1 | 12/2011 | Kondo et al. |
| 2012/0073351 | A1 | 3/2012 | Maki et al. |
| 2012/0085466 | A1 | 4/2012 | Lupp et al. |
| 2012/0085467 | A1 | 4/2012 | Thirion et al. |
| 2012/0135263 | A1 | 5/2012 | Kobayashi et al. |
| 2012/0186705 | A1 | 7/2012 | Sikora et al. |
| 2012/0267012 | A1 | 10/2012 | Sohn et al. |
| 2013/0206824 | A1 | 8/2013 | Wakatabi |
| 2013/0236739 | A1 | 9/2013 | Yoshida et al. |
| 2014/0027026 | A1 | 1/2014 | Schwinghammer et al. |
| 2014/0377584 | A1 | 12/2014 | Hasegawa et al. |
| 2015/0020562 | A1 | 1/2015 | Yamanaka et al. |
| 2015/0147589 | A1 | 5/2015 | Bouaziz |
| 2015/0191813 | A1 | 7/2015 | Maki et al. |
| 2015/0284861 | A1 | 10/2015 | Allely et al. |
| 2018/0044774 | A1 | 2/2018 | Allely |
| 2018/0195159 | A1 | 7/2018 | Sohn et al. |
| 2018/0202017 | A1* | 7/2018 | Drillet ..... C21D 8/0278 |
| 2018/0216218 | A1 | 8/2018 | Machado Amorim |
| 2018/0223386 | A1 | 8/2018 | Machado Amorim |
| 2018/0223409 | A1 | 8/2018 | Allely et al. |
| 2019/0218651 | A1 | 7/2019 | Allely et al. |
| 2019/0271342 | A1 | 9/2019 | Canourgues et al. |

FOREIGN PATENT DOCUMENTS

| | | | |
|---|---|---|---|
| CN | 102791901 | B | 5/2015 |
| DE | 202012000616 | U1 | 2/2012 |
| EP | 1225246 | A1 | 7/2002 |
| EP | 2644736 | A1 | 10/2013 |
| EP | 2695963 | A1 | 2/2014 |
| EP | 2839049 | B1 | 10/2017 |
| JP | S46004045 | A | 2/1971 |
| JP | H04293759 | A | 10/1992 |
| JP | H10176238 | A | 6/1996 |
| JP | H11279735 | A | 10/1999 |
| JP | 2000104153 | A | 4/2000 |
| JP | 2000328216 | A | 11/2000 |
| JP | 2001073108 | A | 3/2001 |
| JP | 2001115247 | A | 4/2001 |
| JP | 2001214280 | A | 8/2001 |
| JP | 2002012959 | A | 1/2002 |
| JP | 2002322527 | A | 11/2002 |
| JP | 2004339530 | A | 12/2004 |
| JP | 2005060728 | A | 3/2005 |
| JP | 2005290418 | A | 10/2005 |
| JP | 2006051543 | A | 2/2006 |
| JP | 2006193776 | A | 7/2006 |
| JP | 2006299377 | A | 11/2006 |
| JP | 2007182608 | | 7/2007 |
| JP | 2008038168 | A | 2/2008 |
| JP | 2008111189 | A | 5/2008 |
| JP | 2010070784 | A | 4/2010 |
| JP | 2010229483 | A | 10/2010 |
| JP | 2010535636 | A | 11/2010 |
| JP | 2011152589 | A | 8/2011 |
| JP | 2012516939 | A | 7/2012 |
| JP | 2015094006 | A | 5/2015 |
| KR | 0146986 | B1 | 11/1998 |
| KR | 100317680 | B1 | 12/2001 |
| RU | 2466210 | C2 | 11/2012 |
| RU | 2544977 | C2 | 3/2015 |
| RU | 2553128 | C2 | 6/2015 |
| UA | 76547 | C2 | 8/2006 |
| WO | 2010085983 | A1 | 8/2010 |
| WO | 2012137687 | A1 | 10/2012 |
| WO | 2013122004 | A1 | 8/2013 |
| WO | 2013156688 | A1 | 10/2013 |
| WO | 2014059475 | A1 | 4/2014 |

OTHER PUBLICATIONS

The International Search Report issued in connection with International Application No. PCT/182015/001284 on Apr. 15, 2016.
The International Preliminary Report on the Patentability issued in connection with International Application No. PCT/182015/001284 on Jan. 30, 2018.
The International Search Report issued in connection with International Application No. PCT/182016/000983 on Sep. 15, 2016.
The International Preliminary Report on the Patentability issued in connection with International Application No. PCT/182016/000983 on Dec. 12, 2017.

* cited by examiner

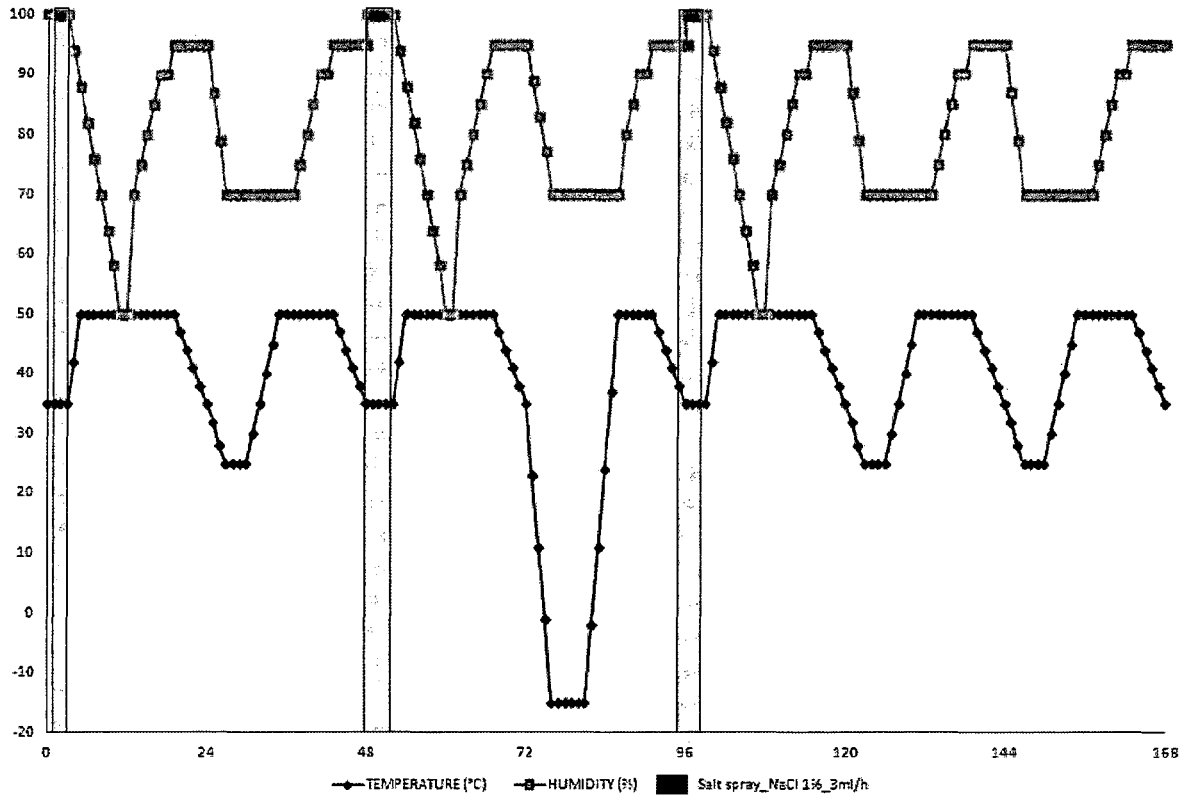
100
90
80
70
60
50
40
30
20
10
0
-10
-20
0
24
48
72
96
120
144
168
TEMPERATURE (°C)
HUMIDITY (%)
Salt spray_NaCl 1%_3ml/h

PHOSPHATABLE PART STARTING FROM A STEEL SHEET COATED WITH A METALLIC COATING BASED ON ALUMINUM

This is a divisional of U.S. patent application Ser. No. 15/748,262, filed on Jan. 29, 2018 which is a National Phase application of PCT/IB2016/001076, filed Jul. 29, 2016 which claims priority to International Patent Application PCT/IB2015/001285, filed on Jul. 30, 2015. All of the above are hereby incorporated by reference herein.

The present invention relates to hardened parts starting from a steel sheet coated with a coating based on aluminum. The part has good characteristics with respect to the phosphating, and therefore exhibits good paint adhesion and good corrosion resistance. The invention is particularly well suited for the manufacture of automotive vehicles.

BACKGROUND

Hardened parts can be coated with an aluminum-based coating having a good corrosion resistance and thermal properties. Usually, the method for manufacture of these parts comprise the provision of the steel sheet, the cut of the sheet to obtain a blank, the thermal treatment of the blank, the hot-stamping followed by a cooling in order to obtain a hardening by martensitic transformation or martensitic-bainitic transformation.

Generally, a paint film is applied on hardened parts, notably an e-coating layer. Previously, a phosphating is often performed. Thus, phosphate crystals are formed on the part surface to be coated, increasing the paint adhesion, and in particular the e-coating layer.

Hardened parts coated with a metallic alloy based on aluminum are not phosphatable, i.e. there is a little or no phosphate crystals formed on the surface of the coating. Thus, the application of the paint film is directly achieved without phosphating step beforehand. The microroughness of the parts surface coated with an alloy based on aluminum allows for paint adhesion. However, in some cases, the paint is not evenly distributed on the part surface resulting in red rust areas.

The patent application US2012/0085466 discloses a method for producing a steel component provided with a metallic coating comprising the following production steps:

a) coating a steel flat product, produced from an alloyed heat-treated steel, with an Al coating comprising at least 85% wt. Al and optionally up to 15% wt. Si;
b) coating the steel flat product provided with the Al coating with a Zn coating comprising at least 85% wt. Zn;
c) coating the steel flat product, provided with the Al coating and the Zn coating lying on it, with a top layer comprising a main constituent of at least one metal salt of phosphoric acid or diphosphoric acid;
d) heat-treating the steel flat product at a heat-treating temperature which is at least 750° C.;
e) heating the steel flat product to a hot-forming temperature;
f) hot-forming the steel component made from the heated steel flat product; and
g) forming a finish-formed steel component by cooling the hot-formed steel component at a cooling rate which is sufficient to form a tempered or martensitic structure.

The hot-formed steel component comprises a base layer comprising at least 30% wt. Al, at least 20% wt. Fe, at least 3% wt. Si and at most 30% wt. Zn; the intermediate layer comprising at least 60% wt. Zn, at least 5% wt. Al, up to 10% wt. F; and up to 10% wt. Si and the top layer comprising at least 8% wt. Zn, as well as ZnO, P and Al, wherein the P content is at most 1% wt. and the main constituent of the top layer is ZnO. The top layer allows for paint adhesion.

However, this process requires the deposition of three layers to form a metallic coating. The Al coating can be deposited by hot-dip galvanization. The Zn coating can be deposited by hot-dip galvanization, physical vapour deposition process or electrolytic galvanizing. The top layer can be deposited by spray coating, dip-coating, vapor deposition or by means of a gel/sol mist.

Consequently, the duration of this method is very long resulting in a loss of productivity and in an increase of productivity costs. Additionally, this patent application discloses that in practice, the top layer predominantly consist of diphosphates and zinc oxide and/or aluminum oxide. Aluminum oxide, also called alumina, is not phosphatable. Finally, this patent application is silent about the coverage rate of phosphate crystals on the coated hot-formed steel.

SUMMARY OF THE INVENTION

An object of the invention is to provide an easy to implement method for the manufacture of a phosphatable hardened part, and consequently having a good paint adhesion, starting from a coated steel sheet. In particular, it aims to make available a hardened part which can be phosphated in order to obtain a high coverage rate of phosphate crystals on the part surface, i.e. a rate superior or equal to 80%.

The present invention provides a method for the manufacture of a hardened part, such part being phosphated, comprising the following steps:

A) the provision of a steel sheet pre-coated with a metallic coating comprising from 4.0 to 20.0% by weight of zinc, from 1.0 to 3.5% by weight of silicon, optionally from 1.0 to 4.0% by weight of magnesium, and optionally additional elements chosen from Pb, Ni, Zr, or Hf, the content by weight of each additional element being less than 0.3% by weight, the balance being aluminum and unavoidable impurities and residuals elements, wherein the ratio Zn/Si is between 3.2 and 8.0,
B) the cutting of the coated steel sheet to obtain a blank,
C) the thermal treatment of the blank at a temperature between 840 and 950° C. to obtain a fully austenitic microstructure in the steel,
D) the transfer of the blank into a press tool,
E) the hot-forming of the blank to obtain a part,
F) the cooling of the part obtained at step E) in order to obtain a microstructure in steel being martensitic or martensitic-bainitic or made of at least 75% of equiaxed ferrite, from 5 to 20% of martensite and bainite in amount less than or equal to 10% and
G) a phosphating step.

The present invention also provides a part coated with a metallic coating obtainable according to the method, comprising a ZnO layer on the metallic coating and a phosphate crystals layer on the ZnO layer.

The present invention further provides the use of such a part for the manufacture of an automotive vehicle.

Other characteristics and advantages of the invention will become apparent from the following detailed description of the invention.

BRIEF DESCRIPTION OF THE DRAWING

To illustrate the invention, various embodiments and trials of non-limiting examples will be described, particularly with reference to the following FIGURE:

FIG. 1 illustrates one corrosion cycle corresponding to 168 hours of the norm VDA 233-102.

DETAILED DESCRIPTION

The following terms will be defined:

"coverage rate of phosphate crystals" is defined by a percentage. 0% means that the surface of the part is not covered at all by phosphate crystals, 100% means that the surface of the part is totally covered by phosphate crystals".

The designation "steel" or "steel sheet" means a steel sheet for press hardening process having a composition allowing the part to achieve a higher tensile strength greater than or equal to 500 MPa, preferably greater than or equal to 1000 MPa, advantageously greater than or equal to 1500 MPa. The weight composition of steel sheet is preferably as follows: 0.03%≤C≤0.50%; 0.3%≤Mn≤3.0%; 0.05%≤Si≤0.8%; 0.015%≤Ti≤0.2%; 0.005%≤Al≤0.1%; 0%≤Cr≤2.50%; 0%≤S≤0.05%; 0%≤P≤0.1%; 0%≤B≤0.010%; 0%≤Ni≤2.5%; 0%≤Mo≤0.7%; 0%≤Nb≤0.15%; 0%≤N≤0.015%; 0%≤Cu≤0.15%; 0%≤Ca≤0.01%; 0%≤W≤0.35%, the balance being iron and unavoidable impurities from the manufacture of steel.

For example, the steel sheet is 22MnB5 with the following composition: 0.20%≤C≤0.25%; 0.15%≤Si≤0.35%; 1.10%≤Mn≤1.40%; 0%≤Cr≤0.30%; 0%≤Mo≤0.35%; 0%≤P≤0.025%; 0%≤S≤0.005%; 0.020%≤Ti≤0.060%; 0.020%≤Al≤0.060%; 0.002≤% B≤0.004%, the balance being iron and unavoidable impurities from the manufacture of steel.

The steel sheet can be Usibor®2000 with the following composition: 0.24%≤C≤0.38%; 0.40%≤Mn≤3%; 0.10%≤Si≤0.70%; 0.015%≤Al≤0.070%; 0%≤Cr≤2%; 0.25%≤Ni≤2%; 0.020%≤Ti≤0.10%; 0%≤Nb≤0.060%; 0.0005%≤B≤0.0040%; 0.003%≤N≤0.010%; 0.0001%≤S≤0.005%; 0.0001%≤P≤0.025%; it being understood that the contents of titanium and nitrogen satisfy Ti/N>3.42; and that the contents of carbon, manganese, chromium and silicon satisfy:

$$2.6C + \frac{Mn}{5.3} + \frac{Cr}{13} + \frac{Si}{15} \geq 1.1\%$$

the composition optionally comprising one or more of the following: 0.05%≤Mo≤0.65%; 0.001%≤W≤0.30%; 0.0005%≤Ca≤0.005%, the balance being iron and unavoidable impurities from the manufacture of steel.

For example, the steel sheet is Ductibor®500 with the following composition: 0.040%≤C≤0.100%; 0.80%≤Mn≤2.00%; 0%≤Si≤0.30%; 0%≤S≤0.005%; 0%≤P≤0.030%; 0.010%≤Al≤0.070%; 0.015%≤Nb≤0.100%; 0.030%≤Ti≤0.080%; 0%≤N≤0.009%; 0%≤Cu≤0.100%; 0%≤Ni≤0.100%; 0%≤Cr≤0.100%; 0%≤Mo≤0.100%; 0%≤Ca≤0.006%, the balance being iron and unavoidable impurities from the manufacture of steel.

Steel sheet can be obtained by hot rolling and optionally cold rolling depending on the desired thickness, which can be for example between 0.7 and 3.0 mm.

The invention relates to a method for the manufacture of a hardened part coated with a phosphatable coating. Firstly, the method comprises the provision of a steel sheet pre-coated with a metallic coating comprising from 4.0 to 20.0% by weight of zinc, from 1.0 to 3.5% by weight of silicon, optionally from 1.0 to 4.0% by weight of magnesium, and optionally additional elements chosen from Pb, Ni, Zr, or Hf, the content by weight of each additional element being less than 0.3% by weight, the balance being aluminum and unavoidable impurities and residuals elements, wherein the ratio Zn/Si is between 3.2 and 8.0.

Without willing to be bound by any theory, it seems that if these conditions are not met, in particular if the amount of silicon is greater than 3.5%, there is a risk that the zinc is localized in aluminum matrix or an intermetallic compound Zn—Al is formed. Thus, zinc cannot rise to the surface of the coated steel sheet. Alumina layer, which is not phosphatable, is formed on the surface of the coated steel sheet.

In most cases, when coverage rate of phosphate crystals is low, there is a risk of poor paint adhesion. However, in some cases, although the coverage rate of phosphate crystals is low, the paint adhesion is good but the corrosion resistance after painting is poor. Indeed, the microroughness of the coated parts surface coated allows for paint adhesion. But, the paint is not evenly distributed on the part surface. In this case, phosphate crystals cannot play the role of binder between the paint and the coating. Consequently, in a corrosive environment, water infiltrates easily under paint resulting in red rust areas.

Preferably, the metallic coating does not comprise elements selected among Cr, Mn, Ti, Ce, La, Nd, Pr, Ca, Bi, In, Sn and Sb or their combinations. In another preferred embodiment, the metallic coating does not comprise any of the following compounds: Cr, Mn, Ti, Ce, La, Nd, Pr, Ca, Bi, In, Sn and Sb. Indeed, without willing to be bound by any theory, it seems that when these compounds are present in the coating, there is a risk that the properties of the coating, such as electrochemical potential, are altered, because of their possible interactions with the essential elements of the coatings.

Advantageously, the metallic coating comprises from 1.5 to 3.5% by weight of silicon, preferably from 1.5 to 2.5% by weight of silicon. In another preferred embodiment, the coating comprises from 2.1 to 3.5% by weight of silicon.

Preferably, the metallic coating comprises from 10.0 to 15.0% by weight of zinc.

In a preferred embodiment, the ratio Zn/Si in the metallic coating is between 5 and 4 and 8, preferably between 4.5 and 7.5 and advantageously between 5 and 7.5.

Without willing to be bound by any theory, it has been found that when the ratio Zn/Si is not between 3.2 and 8, there is a risk that the coverage rate of phosphate crystals decreases because of a too high content of Al and Fe at the coating surface.

Advantageously, the coating comprises from 1.1 to 3.0% by weight of magnesium.

Advantageously, the coating comprises greater than 76% by weight of aluminum.

The coating can be deposited by any methods known to the man skilled in the art, for example hot-dip galvanization process, electrogalvanization process, physical vapour deposition such as jet vapor deposition or sputtering magnetron. Preferably, the coating is deposited by hot-dip galvanization process. In this process, the steel sheet obtained by rolling is dipped in a molten metal bath.

The bath comprises zinc, silicon, aluminum and optionally magnesium. It can comprise additional elements chosen from Pb, Ni, Zr, or Hf, the content by weight of each additional element being less than 0.3% by weight. These additional elements can improve among others ductibility, coating adhesion on the steel sheet.

The bath can also contain unavoidable impurities and residuals elements from feeding ingots or from the passage of the steel sheet in the molten bath. Residual element can be iron with a content up to 3.0% by weight.

The thickness of the metallic coating is usually between 5 and 50 μm, preferably between 10 and 35 μm, advantageously between 12 and 18 μm or between 26 to 31 μm. The bath temperature is usually between 580 and 660° C.

After the deposition of the coating, the steel sheet is usually wiped with nozzles ejecting gas on both sides of the coated steel sheet. The coated steel sheet is then cooled. Preferably, the cooling rate is greater than or equal to 15° C.·$s^{-1}$ between the beginning of the solidification and the end of the solidification. Advantageously, the cooling rate between the beginning and the end of the solidification is superior or equal to 20° C.·$s^{-1}$.

Then, a skin-pass can be realized and allows work hardening the coated steel sheet and giving it a roughness facilitating the subsequent shaping. A degreasing and a surface treatment can be applied in order to improve for example adhesive bonding or corrosion resistance.

Then, the coated steel sheet is cut to obtain a blank. A thermal treatment is applied to the blank in a furnace under non protective atmosphere at an austenitization temperature Tm usually between 840 and 950° C., preferably 880 to 930° C. Advantageously, said blank is maintained during a dwell time tm between 1 to 12 minutes, preferably between 3 to 9 minutes. During the thermal treatment before the hot-forming, the coating forms an alloy layer having a high resistance to corrosion, abrasion, wear and fatigue.

After the thermal treatment, the blank is then transferred to a hot-forming tool and hot-formed at a temperature between 600 and 830° C. The hot-forming comprises the hot-stamping and the roll-forming. Preferably, the blank is hot-stamped. The part is then cooled in the hot-forming tool or after the transfer to a specific cooling tool.

The cooling rate is controlled depending on the steel composition, in such a way that the final microstructure after the hot-forming comprises mostly martensite, preferably contains martensite, or martensite and bainite, or is made of at least 75% of equiaxed ferrite, from 5 to 20% of martensite and bainite in amount less than or equal to 10%.

In a preferred embodiment, the part is a press hardened steel part having a variable thickness, i.e. the press hardened steel part of the invention can have a thickness which is not uniform but which can vary. Indeed, it is possible to achieve the desired mechanical resistance level in the zones which are the most subjected to external stresses, and to save weight in the other zones of the press hardened part, thus contributing to the vehicle weight reduction. In particular, the parts with non-uniform thickness can be produced by continuous flexible rolling, i.e. by a process wherein the sheet thickness obtained after rolling is variable in the rolling direction, in relationship with the load which has been applied through the rollers to the sheet during the rolling process.

Thus, within the conditions of the invention, it is possible to manufacture advantageously vehicle parts with varying thickness in order to obtain for example a tailored rolled blank. Specifically, the part can be a front rail, a seat cross member, a side sill member, a dash panel cross member, a front floor reinforcement, a rear floor cross member, a rear rail, a B-pillar, a door ring or a shotgun.

A phosphatable hardened part according to the invention is obtained.

Preferably, the microstructure of the metallic coating of the part comprises an intermetallic layer $Fe_3Al$, an interdiffusion layer Fe—Si—Al, a low quantity of silicon distributed in the coating and a ZnO layer at the surface of the coating. When magnesium is present in the coating, the microstructure comprises also $Zn_2Mg$ phase and/or $Mg_2Si$ phase. Advantageously, the microstructure does not comprise metallic zinc.

For automotive application, after phosphating step, the part is degreased and phosphated so as to ensure the adhesion of the cataphoresis. After the phosphating, a high coverage rate of phosphate crystals on the surface of the part is obtained. The coverage rate of phosphate crystals on the surface of the part is greater than or equal to 80%, preferably greater than or equal to 90%, advantageously greater than or equal to 99%.

Then, the part is dipped in an e-coating bath. Usually, the thickness of the phosphate layer is between 1 and 2 μm and the thickness of the e-coating layer is between 15 and 25 μm, preferably less than or equal to 20 μm. The cataphoresis layer ensures an additional protection against corrosion.

After the e-coating step, other paint layers can be deposited, for example, a primer coat of paint, a basecoat layer and a top coat layer.

The invention will now be explained in trials carried out for information only. They are not limiting.

EXAMPLES

For all samples, steel sheets used are 22MnB5. The composition of the steel is as follows: C=0.2252%; Mn=1.1735%; P=0.0126%, S=0.0009%; N=0.0037%; Si=0.2534%; Cu=0.0187%; Ni=0.0197%; Cr=0.180%; Sn=0.004%; Al=0.0371%; Nb=0.008%; Ti=0.0382%; B=0.0028%; Mo=0.0017%; As=0.0023% et V=0.0284%.

All coatings were deposited by hot-dip galvanization process.

Example 1: Phosphating Test

Phosphatability test is used to determine the adhesion of phosphate crystals on hardened parts by assessing the coverage rate on the part surface.

Trials 1 to 10 were prepared and subjected to the phosphating test.

To this end, coated trials were cut in order to obtain a blank. Blanks were then heated at a temperature of 900° C. during a dwell time varying between 5 and 10 minutes. Blanks were transferred into a press tool and hot-stamped in order to obtain a part. Finally, the part was cooled to obtain a hardening by martensitic transformation.

A degreasing was then realized. It was followed by a phosphating step realized by dipping into a bath comprising a solution of Gardobond® 24 TA, Gardobond® Add H7141, Gardobond® H7102, Gardobond® Add H7257, Gardobond® Add H7101, Gardobond® Add H7155 during 3 minutes at 50° C. Parts were then wiped with water and dried with hot air. The parts surface were observed by SEM. Results are shown in the following Table 1:

| | Coating | | | | | Thickness | Covering rate after a thermal treatment at 900° C. (%) | |
|---|---|---|---|---|---|---|---|---|
| Trials | Al | Si | Zn | Mg | Zn/Si | (μm) | Dwell time = 5 minutes | Dwell time = 10 minutes |
| 1 | 91 | 9 | — | — | — | 27 | 0 | 0 |
| 2 | 81 | 9 | 10 | — | 1.1 | 27 | <5 | <10 |

-continued

| Trials | Coating Al | Si | Zn | Mg | Zn/Si | Thickness (μm) | Covering rate after a thermal treatment at 900° C. (%) Dwell time = 5 minutes | Dwell time = 10 minutes |
|---|---|---|---|---|---|---|---|---|
| 3 | 76 | 9 | 15 | — | 1.7 | 27 | 0 | 20 |
| 4 | 71 | 9 | 20 | — | 2.2 | 27 | <10 | <10 |
| 5 | 80 | 5 | 15 | — | 3.0 | 27 | 50 | 70 |
| 6 | 78 | 5 | 15 | 2 | 3.0 | 27 | 50 | 50 |
| 7* | 82.5 | 3.5 | 12 | 2 | 3.4 | 27 | >99 | >99 |
| 8* | 88 | 2 | 10 | — | 5 | 27 | 95 | 95 |
| 9* | 83 | 2 | 15 | — | 7.5 | 27 | >99 | >99 |
| 10* | 81 | 2 | 15 | 2 | 7.5 | 27 | ND | 90 |

*examples according to the invention,

ND: not done.

The above results show that Trials 7 to 10 have a high coverage rate of phosphate crystals on hardened part.

Example 2: Paint Adhesion Test

This test is used to determine the paint adhesion of the hardened parts.

An e-coating layer of 20 μm is deposited on Trials 1 to 5 and 7 to 10 prepared in Example 1. To this end, all trials were dipped into a bath comprising an aqueous solution comprising Pigment Paste® W9712-N6 and Resin Blend® W7911-N6 of PPG Industries during 180 seconds at 30° C. A 200V current was applied. Then, the panel was wiped and cured in the oven at 180° C. during 35 minutes.

Then, painted parts are dipped into a sealed box comprising demineralized water during 10 days at a temperature of 50° C. After the dipping, a grid is realized with a cutter. The paint is ripped with a scotch.

The removed paint is assessed by naked eyes: 0 means excellent, in other words, there is a little or no paint removed and 5 means very bad, in other words, there are lots of paint removed. Results are shown in the following Table 2:

| Trials | Coating Al | Si | Zn | Mg | Zn/Si | Paint adhesion after a thermal treatment at 900° C. (%) Dwell time = 5 minutes | Dwell time = 10 minutes |
|---|---|---|---|---|---|---|---|
| 10 | 91 | 9 | — | — | — | 0 | 0 |
| 11 | 81 | 9 | 10 | — | 1.1 | 5 | 5 |
| 12 | 76 | 9 | 15 | — | 1.7 | 5 | 5 |
| 13 | 71 | 9 | 20 | — | 2.2 | 5 | 5 |
| 14 | 80 | 5 | 15 | — | 3.0 | 0 | 0 |
| 15* | 82.5 | 3.5 | 12 | 2 | 3.4 | 0 | 0 |
| 16* | 88 | 2 | 10 | — | 5.0 | 0 | 0 |
| 17* | 83 | 2 | 15 | — | 7.5 | 0 | 0 |
| 18* | 81 | 2 | 15 | 2 | 7.5 | 2 | 0 |

*examples according to the invention.

Trials 15 to 18 according to the present invention show good paint adhesion, as trials 10 and 14.

Example 3: Delamination Test

This test is used to determine the corrosion after painting of the hardened parts.

An e-coating layer of 20 μm is deposited on Trials 1 to 5, 8 and 10 prepared at Example 1. To this end, all trials were dipped into a bath comprising an aqueous solution comprising Pigment Paste® W9712-N6 and Resin Blend® W7911-N6 of PPG Industries during 180 seconds at 30° C. A 200V current was applied. Then, the panel was wiped and cured in the oven at 180° C. during 35 minutes.

Then, scratches were realized on the e-coating layer with a cutter.

Finally, a test, consisting in submitting panels to corrosion cycles according to the norm VDA 233-102, was realized. Trials were put in a chamber wherein an aqueous solution of sodium chloride of 1% by weight was vaporized on trials with a rate of flow of 3 $mL \cdot h^{-1}$. The temperature varied from 50 to −15° C. and the humidity rate varied from 50 to 100%. FIG. 1 illustrates one cycle corresponding to 168 hours, i.e. one week.

The presence of delamination was observed by naked eyes: 0 means excellent, in other words, there is no delamination and 5 means very bad, in other words, there are lots of delamination. Results are shown in the following Table 3:

| Trials | Coating Al | Si | Zn | Mg | Zn/Si | 2 corrosion cycles thermal treatment at 900° C. Dwell time = 5 minutes | Dwell time = 10 minutes | 5 corrosion cycles thermal treatment at 900° C. Dwell time = 5 minutes | Dwell time = 10 minutes |
|---|---|---|---|---|---|---|---|---|---|
| 18 | 91 | 9 | — | — | — | 0.5 | 1 | 4.5 | 5 |
| 19 | 81 | 9 | 10 | — | 1.1 | 5 | 0.5 | ND | ND |
| 20 | 76 | 9 | 15 | — | 1.7 | 5 | 1 | 5 | 5 |
| 21 | 71 | 9 | 20 | — | 2.2 | 4.5 | 4.5 | ND | ND |
| 22 | 80 | 5 | 15 | — | 3.0 | 2 | 2 | 4.5 | 4 |
| 23* | 88 | 2 | 10 | — | 5.0 | 1 | 1 | 2.5 | 3 |
| 24* | 81 | 2 | 15 | 2 | 7.5 | 0.5 | 0.5 | 2 | 2 |

*examples according to the invention,

ND: not done.

Trials according to the invention (Trials 23 and 24) lead to a little delamination after 2 and 5 weeks of corrosion cycle, in contrary to Trials 18 to 22.

What is claimed is:

1. A part comprising:

a part having a metallic coating obtained by a method including: A) providing a steel sheet pre-coated with a metallic coating including 4.0 to 20.0% by weight of zinc; 1.0 to 3.5% by weight of silicon; a balance being aluminum, unavoidable impurities and residual elements; and a ratio Zn/Si being between 3.2 and 8.0; B) cutting the coated steel sheet to obtain a blank; C) performing a thermal treatment on the blank at a temperature between 840 and 950° C. to obtain a fully austenitic microstructure in the steel; D) transferring the blank into a press tool; E) hot-forming the blank to obtain a part; F) cooling the part in order to obtain a microstructure in the steel being martensitic or martensitic-bainitic or made of at least 75% equiaxed ferrite, 5 to 20% of martensite and bainite in an amount less than or equal to 10%; and G) a phosphating step;

a ZnO layer on the metallic coating of the part, wherein the metallic coating does not comprise elements selected among In and Sn or combinations thereof; and a phosphate crystals layer on the ZnO layer.

2. The part as recited in claim 1 wherein a coverage rate of phosphate crystals on the part surface is equal or greater than 90%.

3. The part as recited in claim 2 wherein the coverage rate of phosphate crystals on the part surface is equal or greater than 99%.

4. The part as recited in claim 1 further comprising an e-coating layer on the phosphate crystals layer.

5. The part as recited in claim 1 wherein the metallic coating comprises an intermetallic layer Fe3Al and an interdiffusion layer Fe—Si—Al.

6. The part as recited in claim 1 wherein a microstructure of the metallic coating comprises Zn2Mg phase or Mg2Si phase or both.

7. The part as recited in claim 1 wherein a microstructure of the metallic coating does not comprise metallic zinc.

8. The part as recited in claim 1 wherein the part is a press hardened steel part having a variable thickness.

9. The part as recited in claim 1 wherein the variable thickness is produced by a continuous flexible rolling process.

10. The part as recited in claim 1 wherein the part is a tailored rolled blank.

11. The part as recited in claim 1 wherein the part is a front rail, a seat cross member, a side sill member, a dash panel cross member, a front floor reinforcement, a rear floor cross member, a rear rail, a B-pillar, a door ring or a shotgun.

12. An automotive vehicle comprising:

the part as recited in claim 1.

* * * * *